US008959945B2

(12) United States Patent
Chae et al.

(10) Patent No.: US 8,959,945 B2
(45) Date of Patent: Feb. 24, 2015

(54) REFRIGERATOR

(75) Inventors: Su Nam Chae, Seoul (KR); Jang Seok Lee, Seoul (KR); So Hee Park, Seoul (KR); Youn Seok Lee, Seoul (KR); Min Kyu Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 13/389,648

(22) PCT Filed: Aug. 5, 2010

(86) PCT No.: PCT/KR2010/005130

§ 371 (c)(1),
(2), (4) Date: Feb. 28, 2012

(87) PCT Pub. No.: WO2011/021799

PCT Pub. Date: Feb. 24, 2011

(65) Prior Publication Data

US 2012/0137721 A1 Jun. 7, 2012

(30) Foreign Application Priority Data

Aug. 19, 2009 (KR) ..... 10-2009-0076649

(51) Int. Cl.
*F25D 17/04* (2006.01)
*F25D 23/00* (2006.01)
*F25D 29/00* (2006.01)

(52) U.S. Cl.
CPC ..... *F25D 23/003* (2013.01); *F25B 2500/06* (2013.01); *F25D 29/005* (2013.01); *F25D 2323/0021* (2013.01); *F25D 2323/00265* (2013.01); *F25D 2323/00275* (2013.01)
USPC ..... 62/407; 62/408

(58) Field of Classification Search
CPC ..... F25D 23/003; F25D 2323/0021; F25D 2323/00275; F25D 2323/00265; F25B 2500/06
USPC ..... 62/407, 408, 255, 419, 426, 428, 441; 312/116, 236, 401
See application file for complete search history.

(56) References Cited

U.S. PATENT DOCUMENTS

| | | | | |
|---|---|---|---|---|
| 3,548,923 | A * | 12/1970 | Kunihiko et al. | 165/236 |
| 5,428,973 | A * | 7/1995 | Temmyo et al. | 62/452 |
| 6,116,038 | A * | 9/2000 | Yamada et al. | 62/259.1 |
| 6,955,064 | B2 * | 10/2005 | Lee et al. | 62/453 |
| 8,230,696 | B2 * | 7/2012 | Yamaguchi et al. | 62/449 |
| 2004/0040335 | A1 * | 3/2004 | Lee | 62/419 |
| 2005/0218766 | A1 | 10/2005 | Hwang | 312/405 |

FOREIGN PATENT DOCUMENTS

| | | | |
|---|---|---|---|
| EP | 1 394 485 | A2 | 3/2004 |
| JP | 02-025676 | A | 1/1990 |
| JP | 04-024481 | A | 1/1992 |

OTHER PUBLICATIONS

International Search Report dated Jan. 20, 2012 issued in Application No. PCT/KR2010/005130.

* cited by examiner

*Primary Examiner* — Mohammad M Ali
(74) *Attorney, Agent, or Firm* — Ked & Associates, LLP

(57) ABSTRACT

Disclosed is a refrigerator in which a cool air generation chamber and a machine room are disposed in the upper portion of a main body of the refrigerator, and a structure of a cover grill disposed in front of the cool air generation chamber and the machine room is changed, thereby achieving stable heat radiation of the machine room and efficient operation of the refrigerator.

12 Claims, 4 Drawing Sheets

REFRIGERATOR

This application claims the benefit of Korean Patent Application No. 10-2009-0076649, filed on Aug. 19, 2009, which is hereby incorporated by reference as if fully set forth herein.

BACKGROUND OF THE INVENTION

1. Field of the Invention

The present invention relates to a refrigerator, and more particularly, to a cover grill provided on the front surface of the upper portion of a main body of a refrigerant so as to be opened and closed.

2. Discussion of the Related Art

In general, a refrigerator is an apparatus which supplies cool air generated from an evaporator to a freezing chamber or a refrigerating chamber to maintain freshness of various foods for a long time. Such a refrigerator includes a main body provided with storage chambers to store food in a low temperature state, and doors installed on the front surface of the main body to open and close the storage chambers.

A refrigerating cycle to cool the storage chambers through circulation of a refrigerant is formed in the refrigerator, and a machinery chamber provided with plural electric components to constitute the refrigerating cycle is provided in the main body.

The refrigerating cycle basically includes a compressor to compress a gas refrigerant in a low-temperature and low-pressure state into a high-temperature and high-pressure state, a condenser to condense the refrigerant introduced from the compressor through outdoor air, an expansion valve having a diameter narrower than those of other parts to decompress and expand the refrigerant introduced from the condenser, and an evaporator to evaporate the refrigerant in the low-pressure state having passed through the expansion valve and thus to absorb heat in the chamber.

An air blower fan to cool the compressor and the condenser is installed in the machinery chamber. A suction hole and a discharge hole to suck and discharge outdoor air are provided at one end and the other end of the machinery chamber.

Through the above structure, when the air blower fan is rotated, air is introduced from the suction hole to the inside of the machinery chamber. The introduced air passes through the condenser and the compressor and is discharged to the outside of the machinery chamber through the discharge hole, and the condenser and the compressor are cooled by the outdoor air during the above process.

Refrigerators are divided into a top mount type refrigerator in which a freezing chamber and a refrigerating chamber are disposed vertically and a freezing chamber door and a refrigerating chamber door are configured so as to respectively open and close the freezing chamber and the refrigerating chamber, a bottom freezer type refrigerator in which a refrigerating chamber and a freezing chamber are disposed vertically, a pair of refrigerating chamber doors is rotatably provided at left and right sides of the refrigerating chamber and a drawer-type freezing chamber door is provided so as to slide in a forward and backward direction of the freezing chamber, and a side by side type refrigerator in which a freezing chamber and a refrigerating chamber are disposed horizontally in parallel, in keeping with a trend towards large-scale refrigerators, and a freezing chamber door and a refrigerating chamber door are configured so as to respectively open and close the freezing chamber and the refrigerating chamber pivotally with both side ends of a main body.

Various convenience devices, such as a home bar or dispenser, to allow a user at the outside to easily take food received on the rear surface of a door of a refrigerator without opening of the door may be provided on the door. Further, a rapid cooling chamber to rapidly cool food may be provided in a freezing chamber or a refrigerating chamber of the refrigerator.

Further, a cover grill provided with inlets and outlets to cause outdoor air to be introduced into and discharged from the inside of a conventional machinery chamber of the refrigerator is installed on the front surface of the machinery chamber.

The cover grill allows outdoor air to be introduced into and discharged from the inside of the machinery chamber through the inlets and the outlets. The conventional cover grill causes a difficulty in introducing a sufficient amount of air for heat radiation of components disposed in the machinery chamber.

Moreover, although a large amount of air is introduced into the machinery chamber, the conventional cover grill is not provided with a structure to stably discharge the air to the outside of the main body of the refrigerator, and thus measures to solve the problem have been urgently required.

SUMMARY OF THE INVENTION

Accordingly, the present invention is directed to a refrigerator.

An object of the present invention is to provide a refrigerator in which a machinery chamber is disposed in an upper portion of a main body.

Another object of the present invention is to provide a refrigerator which is provided with a stable channel for air sucked into and discharged from a machinery chamber.

A further object of the present invention is to provide a refrigerator in which an open area ratio of a cover grill is changed so as to efficiently achieve heat radiation of a machinery chamber.

To achieve this object and other advantages and in accordance with the purpose of the invention, as embodied and broadly described herein, a refrigerator includes a refrigerator includes a main body provided with a freezing chamber and a refrigerating chamber, a cool air generation chamber provided in the upper portion of the main body, a machinery chamber disposed adjacent to the cool air generation chamber, and a cover grill disposed in front of the cool air generation chamber and the machinery chamber so as to be opened and closed, and provided with inlets and outlets having different areas.

The area of the inlets may be greater than the area of the outlets.

The inlets and the outlets may be provided in an area ratio of 2:1.

The inlets and the outlets may be provided with guide grills to guide a flow of sucked air and discharged air.

The guide grills may be tilted toward the upper portion of the front surface of the cover grill.

Lifters enabling the cover grill to be opened from the front surface of the main body and closed toward the front surface of the main body may be provided on the cover grill.

A power switch to switch power of the refrigerator on/off when the cover grill is opened may be provided on the upper portion of the main body.

A control panel to control operation of the refrigerator may be provided on the upper portion of the main body opposite to the cover grill.

The inlets may be extended from the cool air generation chamber to a condenser provided in the machinery chamber.

The outdoor air introduced through the inlets of the cover grill may be transferred directly toward a condenser provided in the machinery chamber. The main body may be a built-in type.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, preferred embodiments of the present invention will be described in detail with reference to the accompanying drawings.

Figure 1:
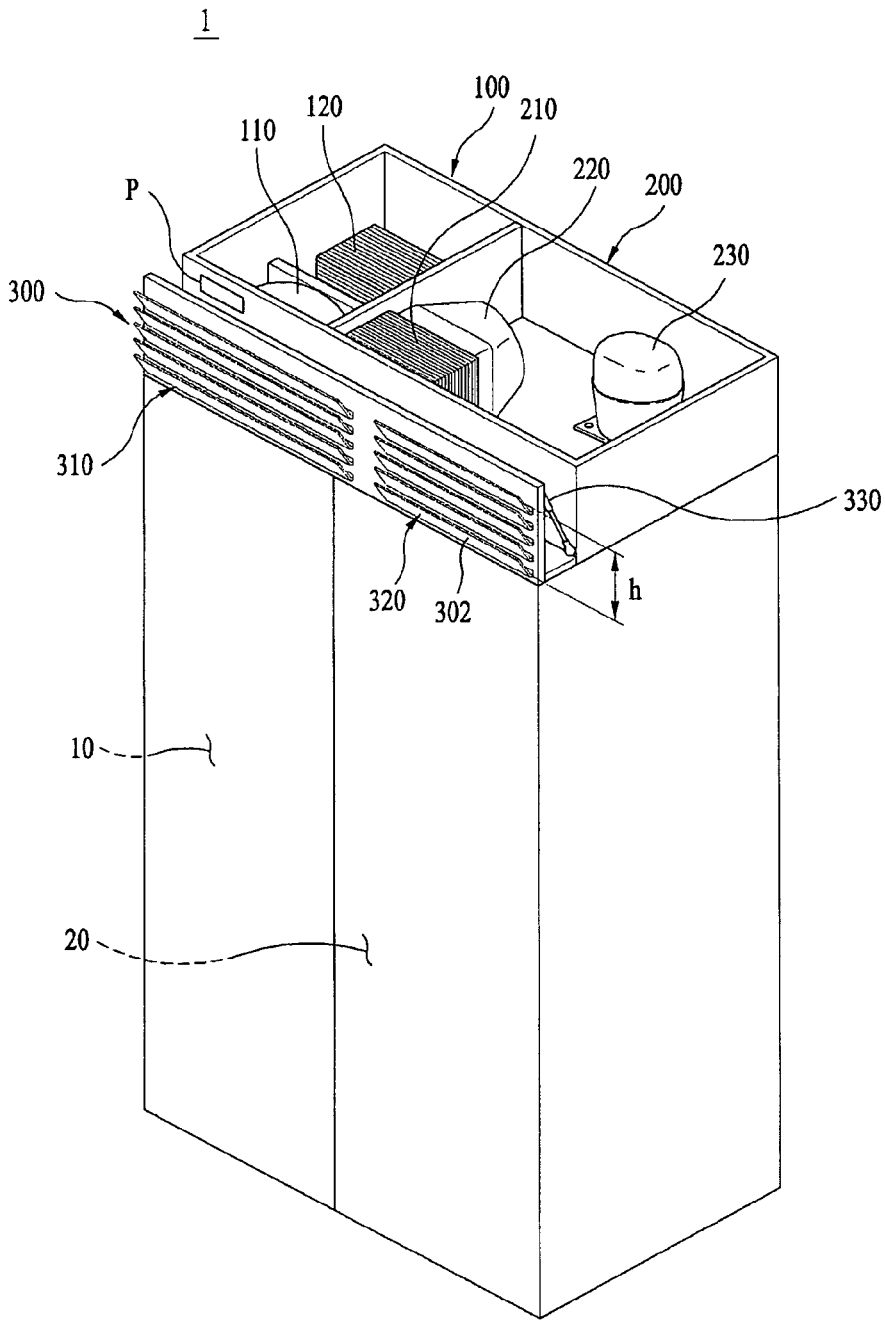
FIG. 1 is a perspective view illustrating a refrigerator in accordance with the present invention.
Figure 2:
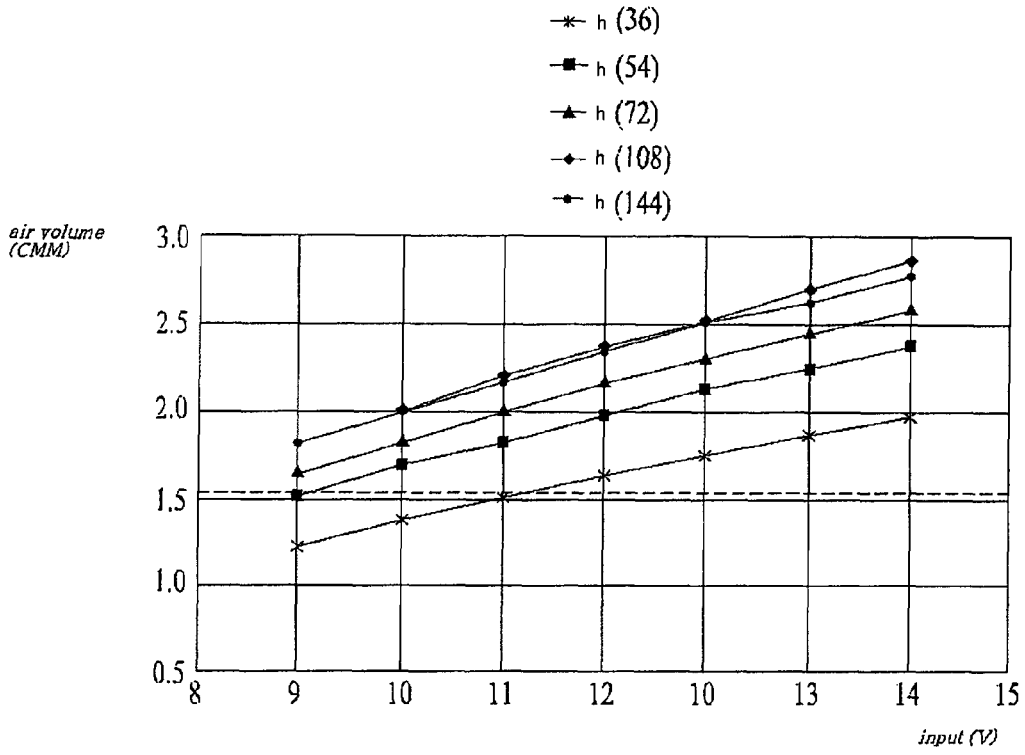
FIG. 2 is a graph showing result of a test carried out by varying the open area height.
Figure 3:
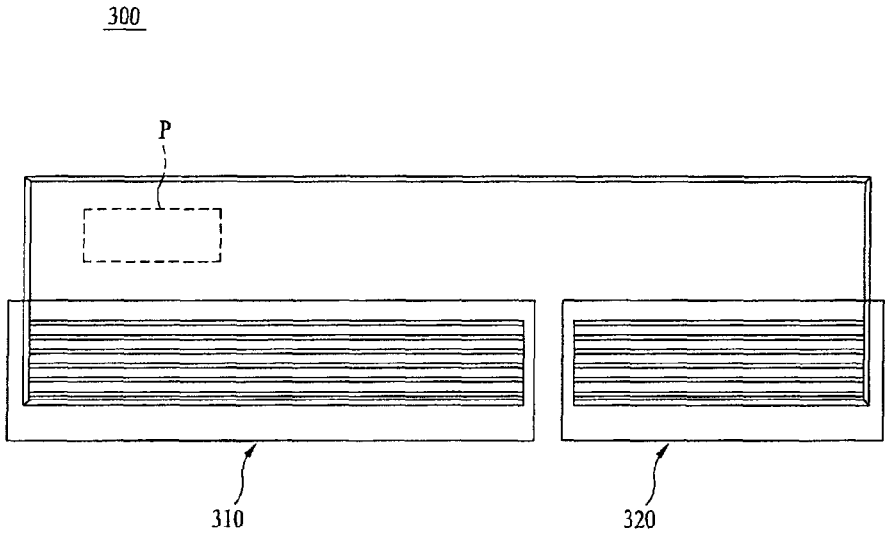
FIG. 3 is a front view of a cover grill provided on the refrigerator in accordance with the present invention.
Figure 4:
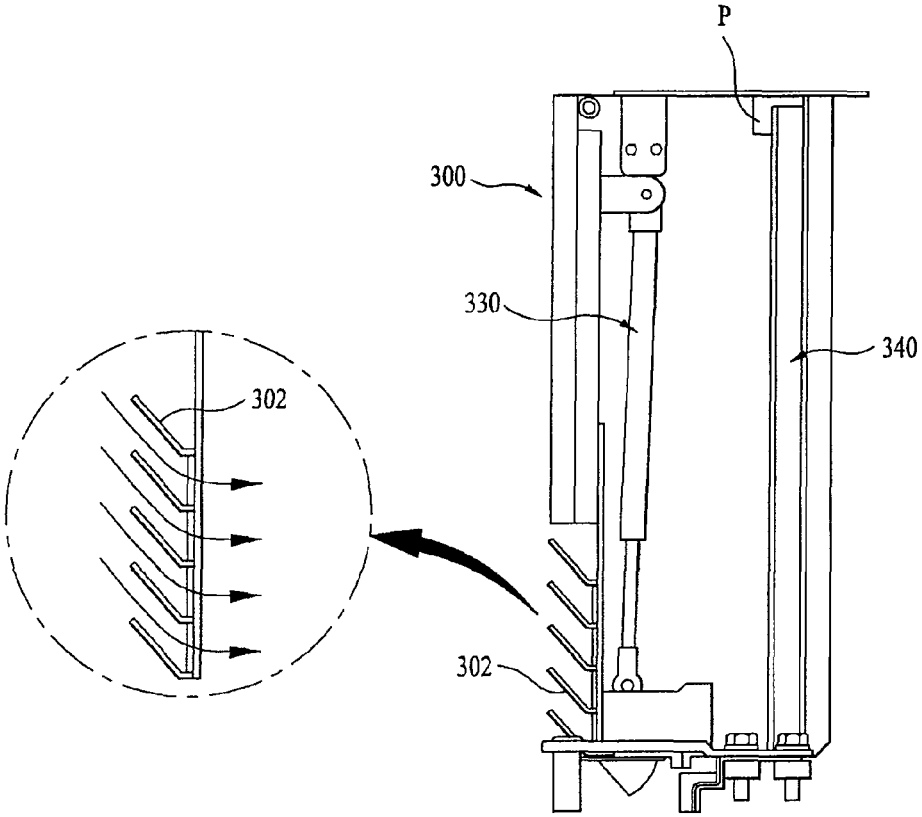
FIG. 4 is a longitudinal-sectional view of the cover grill in accordance with the present invention.
Figure 5:
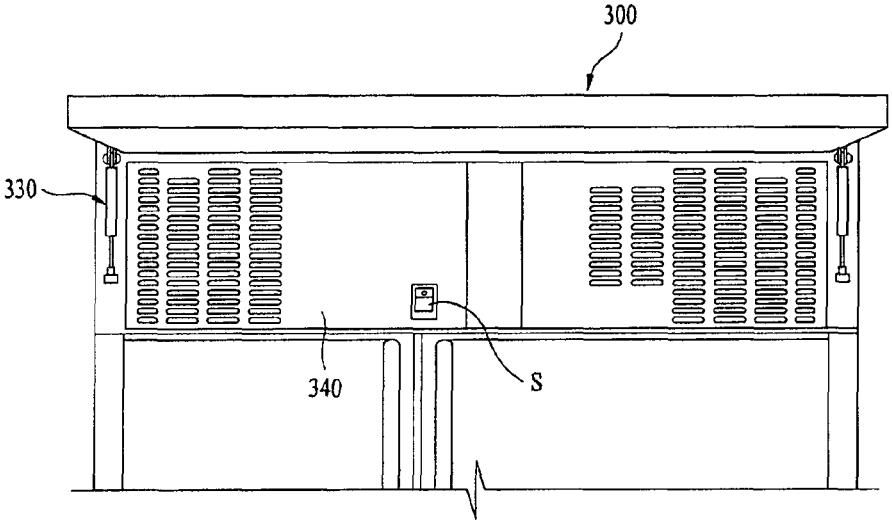
FIG. 5 is a perspective view of the cover grill in an opened state in accordance with the present invention.
Figure 6:
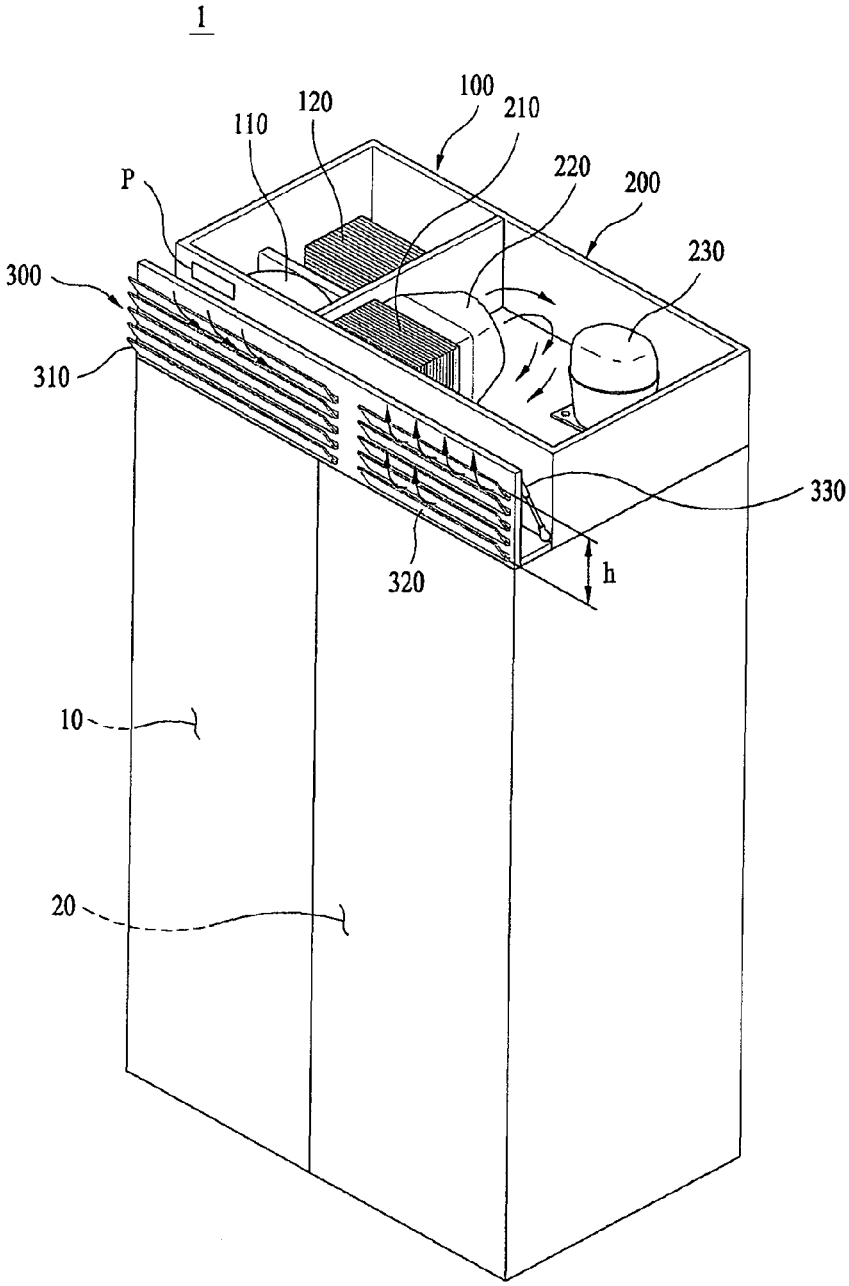
FIG. 6 is a perspective view of the refrigerator in an operating state in accordance with the present invention.

FIG. 1 is a perspective view illustrating a refrigerator in accordance with the present invention, FIG. 2 is a graph showing result of a test carried out by varying the open area height, FIG. 3 is a front view of a cover grill provided on the refrigerator in accordance with the present invention, FIG. 4 is a longitudinal-sectional view of the cover grill in accordance with the present invention, FIG. 5 is a perspective view of the cover grill in an opened state in accordance with the present invention, and FIG. 6 is a perspective view of the refrigerator in an operating state in accordance with the present invention.

With reference to FIG. 1, a machinery chamber 200 is disposed in the upper portion of a main body 1 of the refrigerator in accordance with the present invention, and a cool air generation chamber 100 is disposed adjacent to the machinery chamber.

An evaporator 120 for a freezing chamber and a separate fan 110 are provided in the cool air generation chamber 100, and a condenser 210, a cooling fan 220, and a compressor 230 are disposed in the machinery chamber 100.

A cover grill 300 is installed in front of the cool air generation chamber 100 and the machinery chamber 200 so as to be opened and closed.

The condenser 210 and the cooling fan 220 are disposed collinearly such that outdoor air introduced through the cover grill 300 is introduced directly into the condenser 210.

Inlets 310 and outlets 320 are provided on the front surface of the cover grill 300. The inlets 310 and the outlets 320 have different areas.

An area ratio of the inlets 310 and the outlets 320 of the cover grill 300 will be described in detail with reference to Table 1 below.

In the cover grill 300 in accordance with the present invention, the inlets 310 and the outlets 320 are formed within a limited cover grill area, and in order to form the inlets 310 and the outlets 320 having the optimum open area ratio of the cover grill 300, the open area height (h) of the inlets 310 and the outlets 320 is varied so as to achieve heat radiation of the inside of the machinery chamber 200 through the sucked air introduced into the machinery chamber 200 and to achieve stable discharge of heat-exchanged air having a raised temperature due to heat radiation to the outside.

TABLE 1

| | h (mm) | | | | |
|---|---|---|---|---|---|
| | 36 | 54 | 72 | 108 | 144 |
| Inlet area ($mm^2$) | 15590 | 26930 | 38270 | 49610 | 21260 |
| Outlet area ($mm^2$) | 18715 | 30055 | 41395 | 52735 | 24385 |
| Total ($mm^2$) | 34305 | 56985 | 79665 | 102345 | 45645 |

For example, in order to vary a volume of air introduced and discharged through the cover grill 300 under the condition that the horizontal length of the cover grill 300 is fixed, a test was carried out by varying the open area height (h) of the inlets 310 and the outlets 320 corresponding to the vertical length of the cover grill 300 into 5 states (36 mm, 54 mm, 72 mm, 108 mm, and 144 mm).

As shown in FIG. 2, when the test was carried out by varying the open area height (h) under the condition that the required minimum air volume is set to be more than 1.5 CMM (Cubic Meters per Minute), a graph representing different air volumes according to values of the open area height (h) is obtained.

As a result of the test, 54 mm is selected as the open area height (h) of the cover grill 300 according to the required minimum air volume.

If the open area height (h) exceeds 108 mm or 144 mm, the air volume is scarcely varied. Therefore, 54 mm is selected as the open area height (h) of the cover grill 300 satisfying rated voltage (11V) required by the cooling fan and the required air volume (1.5 CMM), simultaneously.

The area of the inlets 310 is greater than the area of the outlets 320. The reason is that a stable air channel within the machinery chamber 200 is formed and heat of a high temperature generated from the condenser 210 and the compressor 230 disposed within the machinery chamber 200 is effectively radiated to the outside of the refrigerator, only if a sufficient volume of air is introduced into the machinery chamber 200.

The inlets 310 and the outlets 320 are provided in an area ratio of 2:1. Such an area ratio refers to a ratio selected according to a result of calculation of a ratio of respective areas of the inlets 310 and the outlets 320 selected so as to satisfy both the rated voltage of the cooling fan and the required air volume as the result of the test.

Each of the inlets 310 and the outlets 320 is provided with a guide grill 302 to guide a flow of sucked air or discharged air. The guide grill 302 is disposed so as to be tilted toward the upper portion of the front surface of the cover grill 300, thereby preventing the discharged air from being exhausted toward a user's face and thus preventing the heat-exchanged air of a high temperature from being exhausted directly to the user's face.

Now, another embodiment of the guide grill 302 will be described.

The guide grills 302 provided at the inlets 310 may be installed horizontally, and the guide grills 302 provided at the outlets 320 may be tilted upwardly. The reason is that the guide grills 302 installed at the inlets 310 may be installed in a direction of horizontally guiding the sucked air or in a direction of downwardly guiding the sucked air and thus may be installed in a selected direction out of both directions.

Lifters 330 are installed on the cover grill 300. One end of the lifter 330 is connected to the upper portion of the rear surface of the cover grill 300, and the other end of the lifter 330 is installed at the upper portion of the main body 1 or the lower portion of the front surface of a grill 340.

The lifter 330 includes a cylinder and a piston, and the inside of the cylinder may be filled with gas or oil.

A power switch S to switch power of the refrigerator on/off when the cover grill 300 is opened is provided at the upper portion of the main body 1.

With reference to FIG. 5, the power switch S is installed on the front surface of the grill 340, thus enabling a user to easily switch the refrigerator on/off when the cover grill 300 is opened.

When the power switch S is installed in this manner, the user, while using the refrigerator, simply switches on/off power of the refrigerator under the condition that only the cover grill 300 is opened, as needed, thereby improving user's convenience and enabling a worker to rapidly perform maintenance and repair of the refrigerator.

A control panel P is disposed opposite to the cover grill 300 such that the user easily supplies power when the cover grill 300 is opened.

In the refrigerator in accordance with the present invention, the machinery chamber 200 is located in the upper portion of the main body 1, and the refrigerator is installed so as to be built in a wall.

The inlets 310 are configured to have a length (horizontal length) extended from the cool air generation chamber 100 to the condenser 210 provided in the machinery chamber 200. Such a length may be varied to obtain the optimum area ratio of the inlets 310 and the outlets 320.

An operating state of the above refrigerator in accordance with the present invention will be described with reference to the accompanying drawings.

With reference to FIG. 6, when power is applied to the main body 1, the refrigerator is operated, and the compressor 230 disposed in the machinery chamber 200 discharges a refrigerant in a high-temperature and high-pressure state toward the condenser 210. The discharged refrigerant discharges heat of a high temperature to the inside of the machinery chamber 200 through radiation fins provided on the condenser 210.

The control panel P operates the cooling fan 220 to achieve heat radiation of the inside of the machinery chamber 200, and thus enables fresh outdoor air to be sucked to the inside of the machinery chamber 200. Then, air around the cover grill 300 starts to be introduced into the cover grill 300 by suction pressure of the cooling fan.

The guide grills 302 (with reference to FIG. 4) are provided on the cover grill 300, and the air introduced into the machinery chamber 200 through the inlets 310 is guided by the guide grills 302 having the tilted structure.

The air introduced into the machinery chamber 200 through the inlets 310 absorbs heat of a high temperature from the condenser 220 while passing through the condenser 220, and then is transferred to the compressor 230 through the cooling fan 220.

The cooling fan 220 is operated such that a sufficient volume of outdoor air is introduced into the machinery chamber 200 through the inlets 210 having a sufficient open area height (h) while satisfying rated voltage (11V), and the outdoor air having passed through the compressor 230 is transferred through the outlets 320 and is moved to the upper portion of the cover grill 300 by the guide grills 302.

Therefore, suction of outdoor air into the machinery chamber 200 and discharge of the heat-exchanged air to the outside of the machinery chamber 200 are smoothly carried out, and discharge of the heat-exchanged air directly to a user's face is prevented due to guide of the discharged air to the upper portion of the cover grill 300.

Hereinafter, the power switch S and the lifters 330 provided on the refrigerator in accordance with the present invention will be described.

With reference to FIG. 5, in order to switch power of the refrigerator off to move the refrigerator, the cover grill 300 is opened.

When the cover grill 300 is opened, a user easily manipulates the power switch S provided on the front surface of the main body 1, thereby easily switching the power of the refrigerator off and thus easily changing the state of the refrigerator.

Under the condition that the power of the refrigerator is switched off by manipulating the power switch S, the cover grill 300 is closed, and then the refrigerator is moved to a desired position.

The pistons provided in the lifters 330 of the cover grill 300 move along the insides of the cylinders, thereby preventing sudden opening or closing of the cover grill 300.

Gas or oil fills the insides of the cylinders of the lifters 330, and reduces impact generated when the user opens and closes the cover grill 300 so as to induce smooth opening or closing of the cover grill 300.

Next, the control panel P will be disposed. The control panel P is provided at the upper portion of the main body 1, and is located opposite to the cover grill 300 when the cover grill 300 is opened.

For example, if repair of the control panel P is required, a user may easily approach the control panel P in the opened state of the cover grill 300, thus being capable of easily repairing the control panel P.

As is apparent from the above description, a refrigerator in accordance with the present invention enables air to be introduced into and discharged from a machinery chamber so as to achieve stable heat radiation of the inside of the machinery chamber.

The refrigerator in accordance with the present invention enables stable circulation of air within the machinery chamber while satisfying rated voltage of a cooling fan provided in the machinery chamber.

A power switch of the refrigerator in accordance with the present invention is located on the upper portion of a main body, and thus a user easily switches power of the refrigerator on/off.

The refrigerator in accordance with the present invention allows a control panel to be repaired under the condition that only a cover grill is opened, thereby enabling the user to rapidly and easily repair the control panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A refrigerator comprising:

a main body provided with a freezing chamber and a refrigerating chamber;

a cool air generation chamber having an evaporator therein and provided in the upper portion of the main body;

a machine room having a condenser and a compressor therein the machine room being laterally disposed inline with the cool air generation chamber when looking at the main body from a front of the main body; and a cover grill disposed in front of the cool air generation chamber and the machine room so as to be opened and closed, and provided with inlets and outlets, wherein the area of the inlets is larger than the area of the outlets, wherein the inlets are disposed in front of the cool air generation chamber and the condenser and allow air to flow into the machine chamber and in front of the cooling air chamber, and the outlets are disposed in front of the compressor and allows air to flow only from the machine room.

2. The refrigerator according to claim 1, wherein the inlets and the outlets are provided in an area ratio of 2:1.

3. The refrigerator according to claim 1, wherein the inlets and the outlets are provided with guide grills to guide a flow of sucked air and discharged air.

4. The refrigerator according to claim 3, wherein the guide grills are tilted toward the upper portion of the front surface of the cover grill.

5. The refrigerator according to claim 1, wherein a power switch to switch power of the refrigerator on/off is provided on the upper portion of the main body so that the power switch is configured to be exposed when the cover grill is opened.

6. The refrigerator according to claim 1, wherein a control panel to control operation of the refrigerator is provided on the upper portion of the main body opposite to the cover grill.

7. The refrigerator according to claim 1, wherein the inlets are horizontally extended from a front part of the cool air generation chamber to a front part of a condenser provided in the machine room.

8. The refrigerator according to claim 1, wherein the inlet of the cover grill is configured that outdoor air is introduced thereto and transferred directly toward the condenser provided in the machine room therethrough.

9. The refrigerator according to claim 1, wherein the main body is a built-in type.

10. A refrigerator comprising:

a main body provided with a freezing chamber and a refrigerating chamber side by side;

a cool air generation chamber having an evaporator therein and provided in the upper left portion of the main body;

a machine room disposed on a right side of the cool air generation chamber laterally disposed with respect to and inline to the machine room when looking at the main body from a front of the main body, wherein a condenser is installed in the left portion of the machine room and a compressor is installed in a right portion of the machine room; and a cover grill disposed in front of the cool air generation chamber and the machine room so as to be opened and closed, and provided with inlets and outlets having different areas, wherein the inlets are disposed in front of the cool air generation chamber and the condenser and allow air to flow into the machine chamber and in front of the cooling air chamber, and the outlets are disposed in front of the compressor and allows air to flow only from the machine room.

11. A refrigerator comprising:

a main body provided with a freezing chamber and a refrigerating chamber;

a cool air generation chamber having an evaporator therein and provided in the upper portion of the main body;

a machine room having a condenser and a compressor therein disposed alongside the cool air generation chamber;

a cover grill disposed in front of the cool air generation chamber and the machine room so as to be opened and closed, and provided with inlets and outlets, wherein the inlets are disposed in front of the cool air generation chamber and the condenser, and the outlets are disposed in front of the compressor; and a pair of lifters enabling the cover grill to be opened from the front surface of the main body and closed toward the front surface of the main body are provided on the cover grill, wherein the pair of lifters comprises a cylinder, a piston and working fluid provided in the cylinder.

12. The refrigerator according to claim 11, wherein the pair of lifters comprises one end connected to the upper portion of the rear surface of the cover grill, and other end installed at the upper portion of the main body or a lower portion of the front surface of a grill.

* * * * *